US008912713B2

(12) United States Patent
DeSalvo

(10) Patent No.: US 8,912,713 B2
(45) Date of Patent: Dec. 16, 2014

(54) METHOD OF PRODUCING AN ELECTRODE SUPPORT USING BRAZING

(75) Inventor: Peter John DeSalvo, Jacksonville, FL (US)

(73) Assignee: General Electric Company, Schenectady, NY (US)

( * ) Notice: Subject to any disclaimer, the term of this patent is extended or adjusted under 35 U.S.C. 154(b) by 260 days.

(21) Appl. No.: 13/357,314

(22) Filed: Jan. 24, 2012

(65) Prior Publication Data

US 2013/0187530 A1 Jul. 25, 2013

(51) Int. Cl.
*H01T 13/20* (2006.01)

(52) U.S. Cl.
USPC ..... 313/141; 445/7

(58) Field of Classification Search
CPC ..... H01T 21/00; H01T 21/02; H01T 13/467; H01T 13/39; H01J 13/32
USPC ..... 445/7; 313/142, 140, 141, 143
See application file for complete search history.

(56) References Cited

U.S. PATENT DOCUMENTS

| | | | | |
|---|---|---|---|---|
| 3,586,903 | A | 6/1971 | Taterzynski et al. | |
| 5,502,294 | A | 3/1996 | Yang | |
| 5,563,468 | A * | 10/1996 | Abe et al. | 313/141 |
| 6,676,468 | B2 | 1/2004 | Ishiguro et al. | |
| 8,485,857 | B1 * | 7/2013 | DeSalvo | 445/7 |
| 2002/0055318 | A1 | 5/2002 | Ishiguro et al. | |
| 2002/0075125 | A1 | 6/2002 | Yang | |
| 2003/0085644 | A1 * | 5/2003 | Sugiyama et al. | 313/141 |
| 2007/0228916 | A1 * | 10/2007 | Kunitomo et al. | 313/143 |
| 2009/0189503 | A1 * | 7/2009 | Below | 313/141 |

FOREIGN PATENT DOCUMENTS

| | | | |
|---|---|---|---|
| EP | 0400950 | A1 | 12/1990 |
| EP | 0400950 | B1 | 2/2000 |
| EP | 1037345 | A1 | 9/2000 |

OTHER PUBLICATIONS

Nickel Alloys for Electronics, 1988, Nickel Development Institute, Series No. 11 002, pp. 7-9.*

Special Metals Inconel Alloy 600, 2008.*

* cited by examiner

*Primary Examiner* — Anh Mai

*Assistant Examiner* — Glenn Zimmerman

(74) *Attorney, Agent, or Firm* — Cantor Colburn LLP

(57) ABSTRACT

A method of producing an electrode support for a spark plug is provided. The method includes providing the electrode support. The method includes brazing a chip to the electrode support.

15 Claims, 2 Drawing Sheets

METHOD OF PRODUCING AN ELECTRODE SUPPORT USING BRAZING

BACKGROUND OF THE INVENTION

The subject matter disclosed herein relates to a method of producing an electrode support for a spark plug, and more specifically to a method of producing an electrode for a spark plug using brazing.

Spark plugs include an electrode chip located at an end of a center electrode. A separate chip is also located on an end of a side or ground electrode. An air or spark gap is located between the chip positioned on the center electrode and the chip positioned on the ground electrode. In one approach, the spark plug is manufactured by welding a single chip to both the center electrode and the ground electrode. Then, the chip is then machined to create the spark gap between the center electrode and the ground electrode. The chip is generally constructed from a precious or noble metal such as, for example, a platinum based alloy. Noble and precious metals usually have a relatively high cost.

Several drawbacks in the current manufacturing approach generally exist. For example, welding may result in cracks in a weld joint, due to a mismatch in the coefficient of thermal expansion between the different materials that the chip and the center and ground electrodes are constructed from. Also, welding consumes a portion of the relatively costly material the chip is constructed from.

BRIEF DESCRIPTION OF THE INVENTION

According to one aspect of the invention, a method of producing an electrode support for a spark plug is provided. The method includes providing the electrode support. The method includes brazing a chip to the electrode support.

According to another aspect of the invention, a spark plug is provided having an electrode support, a side chip, and a center chip. The electrode support includes a center portion and a side portion. The side chip is brazed to both the center portion of the electrode support. The center chip is brazed to the center portion of the electrode support.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
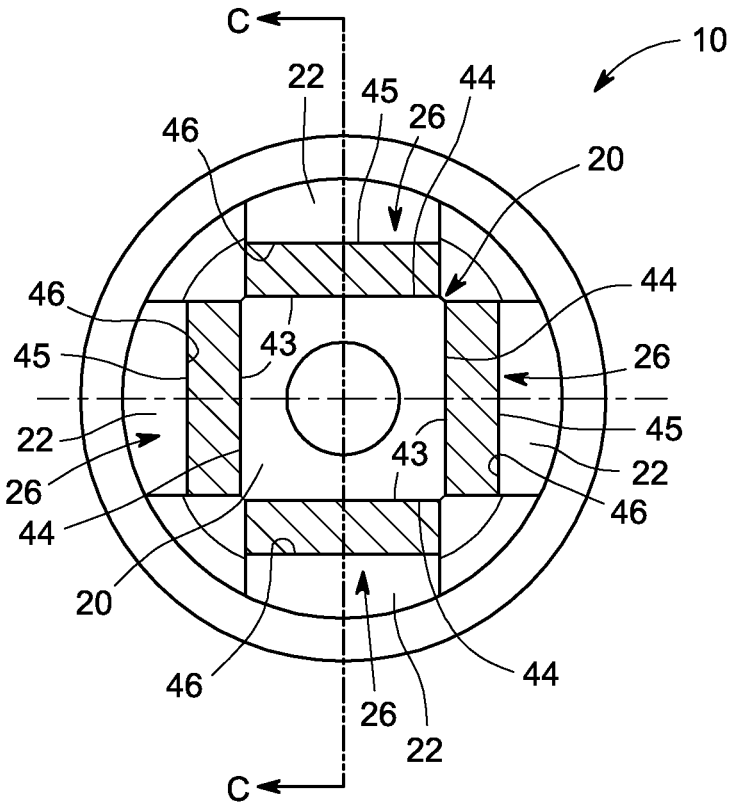
FIG. 1 is a top view of an electrode support for a spark plug.

FIG. 1 is an illustration of an exemplary electrode support 10 for a spark plug (not shown). In one exemplary embodiment, the electrode support 10 may be used in a spark plug of an industrial engine. The electrode support 10 includes a center portion 20 and a plurality of ground or side portions 22. The electrode support 10 also includes a plurality of electrode chips 26 attached to the electrode support 10. Specifically, in the embodiment as shown in FIG. 1, the electrode support 10 is part of a multi-electrode spark plug. In the embodiment as shown, the electrode support 10 includes four electrode chips 26 that are each spaced generally equidistant from one another, however, it is to be understood that any number of side portions 22 may be used as well.

The electrode chip 26 is constructed from an electrode material. A portion of the electrode material is eventually removed by a material removal process such as, for example, machining, to create a spark gap 50 (shown in FIG. 3). The electrode material may be, for example, a noble metal. In one embodiment, the electrode material is a precious metal such as, for example, platinum or silver.

Figure 2:
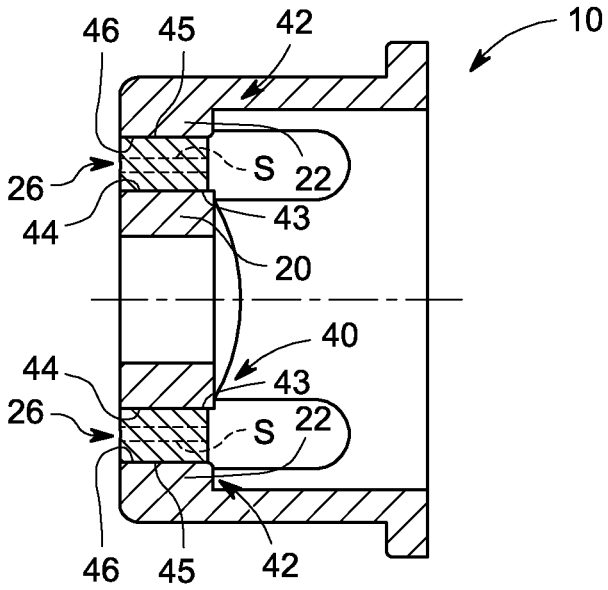
FIG. 2 is a cross-sectioned view of the electrode support shown in FIG. 1.

FIG. 2 is a cross-sectioned view of the electrode support 10 shown in FIG. 1 taken along section C-C. Referring now to both FIGS. 1-2, each of the electrode chips 26 are attached to an end portion 40 of the center portion 20. Each of the electrode chips 26 are also attached to an end portion 42 of a corresponding one of the side portions 22 of the electrode support 10. Specifically, a surface 43 of each of the electrode chips 26 are attached to an outer surface 44 of the center portion 20. A surface 45 of each of the electrode chips 26 are attached to an outer surface 46 of the corresponding side portion 22. The outer surface 46 of the side portion 22 is oriented to generally oppose the outer surface 44 of the center portion 20.

The electrode chip 26 is attached to either the outer surface 44 of the center portion 20 or the outer surface 46 of the corresponding side portion 22 by a brazing process. Brazing the electrode chip 26 to the electrode support involves employing a filler material to join the electrode material to the electrode support 10. Brazing may improve contact and subsequent heat transfer between the electrode chip 26 and the electrode support 10 when compared to some other types of joining processes such as, for example, welding. Brazing also reduces stress between the electrode ship 26 and the electrode support 10 by substantially reducing or eliminating the built-in stress risers that are generally associated with other types of joining approaches. Moreover, because a filler material is used, the brazed configuration between the electrode chip 26 and the electrode support 10 does not consume a portion of the relatively costly electrode material, unlike a weld joint.

The electrode support 10 may be constructed from a metal material that has a relatively low coefficient of thermal expansion such as, for example, nickel iron alloys. For example, in one embodiment, the electrode support 10 includes a coefficient of thermal expansion that ranges from between about $4\times10^{-6}\,K^{-1}$ to about $12\times10^{-6}\,K^{-1}$. In one exemplary embodiment, the electrode support 10 may be constructed an iron-nickel-cobalt alloy conforming to ASTM F-15 or UNS N14052. Specifically, the electrode support 10 and the electrode chip 26 may both be constructed from materials having substantially the same coefficient of thermal expansion. For example, in one embodiment, the electrode chip 26 may be constructed from a noble metal having a coefficient of thermal expansion that ranges from between about $5\times10^{-6}\,K^{-1}$ to about $10\times10^{-6}\,K^{-1}$. The compatible coefficients of thermal expansion results in a reduced amount of stress on the braze joint (not shown) when the electrode chip 26 and the electrode support 10 are brazed together compared to other joining approaches such as welding.

Figure 3:
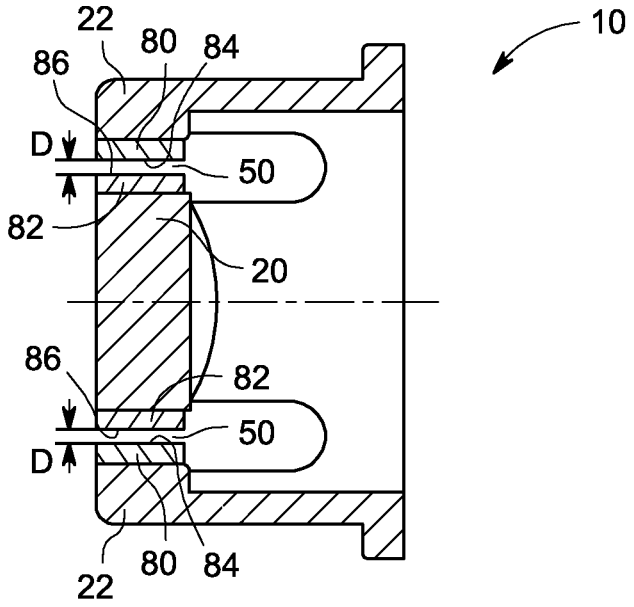
FIG. 3 is an illustration of the electrode support with a spark gap.

FIG. 3 is an illustration of the electrode support 10 with the spark gap 50. Specifically, the spark gap 50 is located between a side electrode chip 80 that is brazed to the side portion 22 and a center electrode chip 82 that is brazed to the center portion 20. The spark gap 50 includes a distance D measured from a surface 84 of the side electrode chip 80 and a surface 86 of the center electrode chip 82. The surface 84 of the side electrode chip 80 generally opposes the surface 86 of the center electrode chip 86. The spark gap 50 represents a portion of the electrode material S (shown in phantom line in FIG. 2) that has been removed. The spark gap 50 may be created by a material removal process such as, for example, machining.

Figure 4:
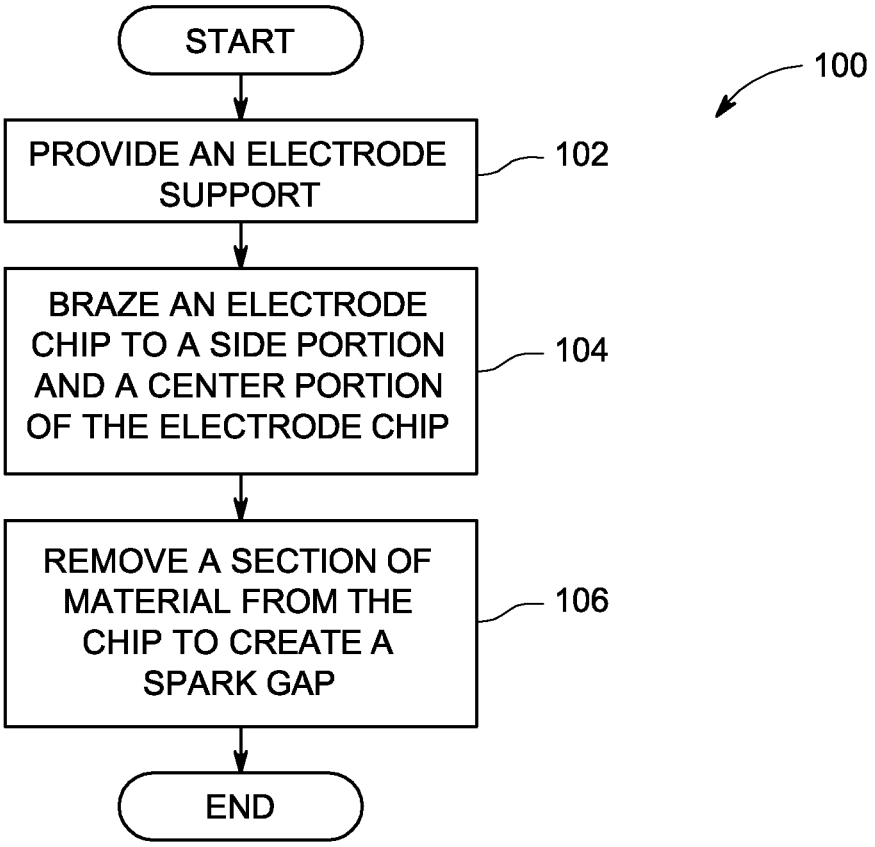
FIG. 4 is a process flow diagram of one approach to produce the electrode support shown in FIG. 4.

FIG. 4 is a process flow diagram of another approach of producing the electrode support 10. Referring now to FIGS. 1-4, process 100 begins at 102, where the electrode support 10 is provided. Process 100 may then proceed to 104, where the electrode chip 26 is brazed to both the side portion 22 and the center portion 20 of the electrode support 10. Process 100 may then proceed to 106, where a material removal process such as, for example, machining is used to remove a section of the electrode chip 26 and thereby create the spark gap 50 as shown in FIG. 4.

Referring generally to FIGS. 1-4, brazing may be used to join the electrode chip 26 to the electrode support 10. Brazing may reduce or substantially eliminate some of issues that are created with welding. For example, a brazed configuration between the electrode chip 26 and the electrode support 10 does not consume a portion of the relatively costly electrode material, unlike a weld joint. Moreover, the electrode support 10 and the electrode chip 26 are both constructed from materials having substantially the same coefficient of thermal expansion. The substantially similar coefficients of thermal expansion between the electrode support 10 and the electrode chip 26 facilitate brazing of the electrode support 10 and the electrode chip 26.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of producing an electrode support for a spark plug, comprising:

providing the electrode support; and brazing a portion of an outer surface of a chip to a center portion of the electrode support and another portion of the chip to a side portion of the electrode support, wherein the center portion of the electrode support is formed of a material having the same coefficient of thermal expansion as the chip.

2. The method as recited in claim 1, comprising substantially removing a section of an electrode material from the chip to create a spark gap.

3. The method as recited in claim 2, comprising substantially removing the section from the chip by machining.

4. The method as recited in claim 1, comprising constructing the electrode support from a metal based material that has a coefficient of thermal expansion that ranges from between about $4\times10^{-6}$ $K^{-1}$ to about $12\times10^{-6}$ $K^{-1}$.

5. The method as recited in claim 1, wherein the chip is constructed at least in part from one of a noble metal and a precious metal.

6. The method as recited in claim 1, wherein the electrode support is constructed from an iron-nickel-cobalt alloy conforming to ASTM F-15.

7. A method of producing an electrode support for a spark plug, comprising:

providing the electrode support, the electrode support having a center portion and a side portion;

brazing a chip to both the center portion and the side portion of the electrode support, wherein the center portion of the electrode support is formed of a material having the same coefficient of thermal expansion as the chip; and removing a section of an electrode material from the chip to create a spark gap.

8. The method as recited in claim 7, comprising brazing a portion of an outer surface of the chip to the center portion of the electrode support, and another portion of the outer surface of the chip to the side portion of the electrode support.

9. The method as recited in claim 7, comprising removing the section from the chip by machining.

10. The method as recited in claim 7, comprising constructing the electrode support from a metal based material that has a coefficient of thermal expansion that ranges from between about $4\times10^{-6}$ $K^{-1}$ to about $12\times10^{-6}$ $K^{-1}$.

11. The method as recited in claim 7, wherein the chip is constructed at least in part from one of a noble metal and a precious metal.

12. A spark plug, comprising:

an electrode support having a center portion and a side portion;

a side chip brazed to the side portion of the electrode support; and a center chip brazed to the center portion of the electrode support, wherein the center portion of the electrode support is formed of a material having the same coefficient of thermal expansion as the side chip and the center chip.

13. The spark plug as recited in claim 12, wherein the electrode support is constructed from a metal based material that has a coefficient of thermal expansion that ranges from between about $4\times10^{-6}$ $K^{-1}$ to about $12\times10^{-6}$ $K^{-1}$.

14. The spark plug as recited in claim 12, wherein the side chip and the center chip are constructed at least in part from one of a noble metal and a precious metal.

15. The method as recited in claim 12, wherein the electrode support is constructed from an iron-nickel-cobalt alloy conforming to ASTM F-15.

* * * * *